US006446285B1

(12) United States Patent
Chinn

(10) Patent No.: US 6,446,285 B1
(45) Date of Patent: Sep. 10, 2002

(54) TILTABLE STRETCHER TABLE ASSEMBLY

(75) Inventor: Robert C. Chinn, Atlanta, GA (US)

(73) Assignee: FernO-Washington, Inc., Wilmington, OH (US)

( * ) Notice: Subject to any disclaimer, the term of this patent is extended or adjusted under 35 U.S.C. 154(b) by 62 days.

(21) Appl. No.: 09/640,354

(22) Filed: Aug. 16, 2000

(51) Int. Cl.[7] ..... A61G 1/04

(52) U.S. Cl. ..... 5/507.1; 5/650; 5/626; 108/49

(58) Field of Search ..... 5/626, 507.1, 503.1, 5/504.1, 505.1, 506.1, 658; 108/25, 48, 49

(56) References Cited

U.S. PATENT DOCUMENTS

| | | | | |
|---|---|---|---|---|
| 1,849,926 A | | 3/1932 | Holtkamp | |
| 2,483,920 A | * | 10/1949 | McLean et al. | 5/507.1 |
| 2,547,642 A | * | 4/1951 | Heuser | 5/507.1 |
| 2,837,389 A | | 6/1958 | Brown | |
| 3,813,714 A | * | 6/1974 | Sater | 108/49 |
| 3,854,155 A | | 12/1974 | Picard | |
| 4,108,083 A | | 8/1978 | Espinosa | |
| 4,557,453 A | * | 12/1985 | McCloskey | 5/507.1 |
| 4,747,172 A | * | 5/1988 | Hohol et al. | 5/507.1 |
| 4,783,109 A | | 11/1988 | Bucalo | |
| 4,848,710 A | | 7/1989 | Newman | |
| 5,077,843 A | | 1/1992 | Dale et al. | |
| 5,152,486 A | * | 10/1992 | Kabanek et al. | 5/507.1 |
| 5,322,072 A | | 6/1994 | Harrison et al. | |
| 5,681,018 A | | 10/1997 | Hoftman | |
| 5,845,351 A | | 12/1998 | Berta et al. | |
| 5,966,760 A | | 10/1999 | Gallant et al. | |

* cited by examiner

*Primary Examiner*—Michael F. Trettel
(74) *Attorney, Agent, or Firm*—Killworth, Gottman, Hagan & Schaeff, L.L.P.

(57) ABSTRACT

A stretcher table assembly is provided for attachment over an ambulance stretcher. The stretcher table assembly includes a tiltable support surface for securing emergency medical equipment used during an emergency thereon. The tiltable support surface may be inclined to permit technicians to more easily view the equipment secured thereon. Additionally, the support surface has a grid of holes upon which anchoring devices may be positioned. The anchoring devices permit emergency medical equipment to quickly and easily secure to the support surface without the need of adjusting a strap or buckle. A pair of legs extends away from the support frame and has attachment feet for engaging the rails of the stretcher. Each of the legs is secured to the rails by an attached securing mechanism. The securing device releasably holds the tiltable stretcher table assembly in place over the stretcher.

21 Claims, 4 Drawing Sheets

TILTABLE STRETCHER TABLE ASSEMBLY

BACKGROUND OF THE INVENTION

The present invention relates to a stretcher table assembly which may be easily and securably mounted to an ambulance stretcher and more particularly to a stretcher table assembly which is adapted to secure emergency medical equipment used in the care of an injured or ill patient quickly without the need of adjusting a strap or buckle, and which permits the equipment secured thereon to be upwardly tilted for the purpose of medical personnel obtaining a better view.

A typical ambulance stretcher must be relatively compact to fit within an ambulance or transport helicopter and to allow sufficient room for medical personnel to attend to the patient during transport. While most stretchers include various auxiliary fittings for attaching and carrying some emergency medical equipment, design constraints prevent the inclusion of easily accessible shelves or compartments on the stretcher for the transport of such emergency medical equipment. Emergency medical equipments, such as intravenous bags, oxygen tanks, cardiac monitors, defibrillators, and pumps, are commonly used in an emergency situation. This equipment must be transported with the patient and needs to be easily accessible. During an emergency situation, there are normally one or two emergency technicians available for the care and transport of the patient. The technicians are not only responsible for caring and transporting the patient, but also carrying, using and monitoring the emergency medical equipment. These responsibilities strain the capabilities of even the most talented technicians. Previously, technicians were forced to place most of the emergency medical equipment on the stretcher mattress and commonly on the patient himself. Such an arrangement is disadvantageous because the equipment is relatively inaccessible, is susceptible to interference by the patient, and may contact an injured area on the patient.

Prior art devices have been developed to address the problems associated with transporting emergency medical equipment with the patient. One prior art device is disclosed in U.S. Pat. No. 4,783,109, issued to Bucalo. The '109 patent discloses a tubular framework that is attachable to a standard ambulance stretcher by known mechanical fittings, and supports at least one shelf above a patient on the stretcher. The shelf provides support for vital life support equipment that must accompany the patient as he or she is transported on the stretcher. Another prior art device is disclosed in U.S. Pat. No. 5,845,351, issued to Berta et al. The '351 patent discloses a stretcher table comprising a horizontal tray for securing medical equipment used during an emergency supported between two downwardly extending legs that have attachment devices for securing the table to a stretcher. Although these stretcher tables have worked well for their intended purposes, they have been deficient in other areas.

The prior art method of securing medical equipment to these stretcher tables typically utilizes an adjustable strap or buckle. In some instances, securing medical equipment of different sizes together on the stretcher table is awkward. Further, it is often time-consuming when it is necessary to arrange the equipment's position and to adjust straps or buckles in order to secure the equipment thereon. In other instances, due to its shape and size, certain medical equipment must be laid flat on the stretcher with its instrument panel and monitor facing upwards. Such placement of these pieces of equipment requires medical personnel to continuously get up in a moving vehicle to make observations, which increases the risk of injury to both the patient and the accompanying medical personnel.

Accordingly, there remains a need for a stretcher table assembly which may be easily and securably mounted to an ambulance stretcher and which is adapted to secure emergency medical equipment used in the care of an injured or ill patient quickly without the need of adjusting a strap or buckle, and which permits the equipment secured thereon to be upwardly tilted for the purpose of enabling a medical person to view such equipment without the need to change positions during patient transport.

SUMMARY OF THE INVENTION

The present invention meets the aforementioned need by providing a stretcher table assembly which may be easily and securably mounted to an ambulance stretcher and which is adapted to secure emergency medical equipment used in the care of an injured or ill patient quickly without the need of adjusting a strap or buckle, and which permits the equipment secured thereon to be upwardly tilted for the purpose of enabling medical personnel to obtain a better view of the equipment without changing positions.

The stretcher table assembly includes a tabletop or support surface of spaced anchor holes arranged in a grid for fixedly receiving a plurality of anchoring devices thereon. A locking member, which is provided to each piece of emergency medical equipment, engages one of the anchoring devices affixed to the tabletop, thereby removably affixing the emergency medical equipment to the tabletop at a particular position thereon quickly and easily. The equipment can be repositioned on the tabletop surface simply by relocating the anchoring devices to another location thereon. The anchoring devices prevent the emergency medical equipment from sliding off the tabletop surface when in an upwardly-tilted position.

The tabletop is hinged to a support frame to permit upward tilting of the tabletop for the purpose of medical personnel obtaining a better view of emergency medical equipment secured thereon. A pair of arms is rotatably mounted at their first ends to sides of the tabletop and slidably mounted at their second ends within an opposing pair of slots provided in sides of the support frame. The pair of arms releasably secures the tabletop in an inclined position. Foldable legs having first and second ends, are rotatably coupled at their first ends to the support frame. Each leg is provided with a pair of securing feet which stand upon the rails of the emergency stretcher. The pair of legs each further includes a securing mechanism positioned generally adjacent the second end of each leg to releasably attach each leg to a respective rail of the emergency stretcher.

According to a first aspect of the present invention, the stretcher table assembly includes a support frame having first and second ends opposing each other. A substantially planar support surface is pivotally connected to the support frame and is adapted to be releasably secured in an inclined position. A first leg having first and second ends is provided, with the first end of the first leg coupled to the support frame generally adjacent the first end of the support frame; the first leg further comprises an attachment member positioned generally adjacent the second end of the first leg and a first securing mechanism adapted to be releasably and securely attached to a respective rail of a stretcher. The assembly further includes a second leg having first and second ends, with the first end of the second leg coupled to the support frame generally adjacent the second end of the support frame; the second leg further comprises an attachment member positioned generally adjacent the second end of the second leg and a second securing mechanism adapted to be releasably and securely attached to a respective rail of a stretcher.

According to another aspect of the present invention, the stretcher table assembly includes a substantially planar support frame having first and second ends opposing each other. A substantially planar support surface is pivotally connected to the support frame and is adapted to be releasably secured in an inclined position. A first leg having first and second ends is provided, with the first end coupled to the support frame generally adjacent the first end of the support frame. The first leg further includes a slot, an attachment member positioned generally adjacent the second end of the first leg, and a securing mechanism slidably engaged to the slot, with the securing mechanism adapted to be releasably and securely attached to a respective rail of a stretcher. A second leg having first and second ends is also provided, with the first end coupled to the support frame generally adjacent the second end of the support frame. The second leg further includes a slot, an attachment member positioned generally adjacent the second end of the second leg, and a securing mechanism slidably engaged to the slot, with the securing mechanism adapted to be releasably and securely attached to a respective rail of a stretcher.

According to yet another aspect of the present invention, the stretcher table assembly includes a substantially planar support frame having first and second ends opposing each other. A substantially planar support surface is pivotally connected to the support frame and is adapted to be releasably secured in an inclined position. A first leg having first and second ends is provided, with the first end coupled to the support frame generally adjacent the first end of the support frame. The first leg further includes a slot, and an attachment member positioned generally adjacent the second end of the first leg. A securing mechanism slidably engages the slot, and includes a hook member and an adjuster tab. The securing mechanism is adapted to be releasably and securely attached to a respective rail of a stretcher. A second leg having first and second ends is also provided, with the first end coupled to the support frame generally adjacent the second end of the support frame, the second leg further includes a slot, and an attachment member positioned generally adjacent the second end of the second leg. A securing mechanism slidably engages the slot, and includes a hook member and an adjuster tab. The securing mechanism is adapted to be releasably and securely attached to a respective rail of a stretcher, wherein the securing mechanisms of the first and second legs are secured to the stretcher by sliding the securing mechanisms in the slots of the first and second legs until the hook members are firmly engaged around the respective rails on the stretcher. The hook members are secured by rotating the adjuster tabs to a securing position.

BRIEF DESCRIPTION OF THE DRAWINGS

FIG. 2 is a side view of the stretcher table assembly illustrated in. FIG. 1;

DETAILED DESCRIPTION OF THE PREFERRED EMBODIMENTS

Figure 1:
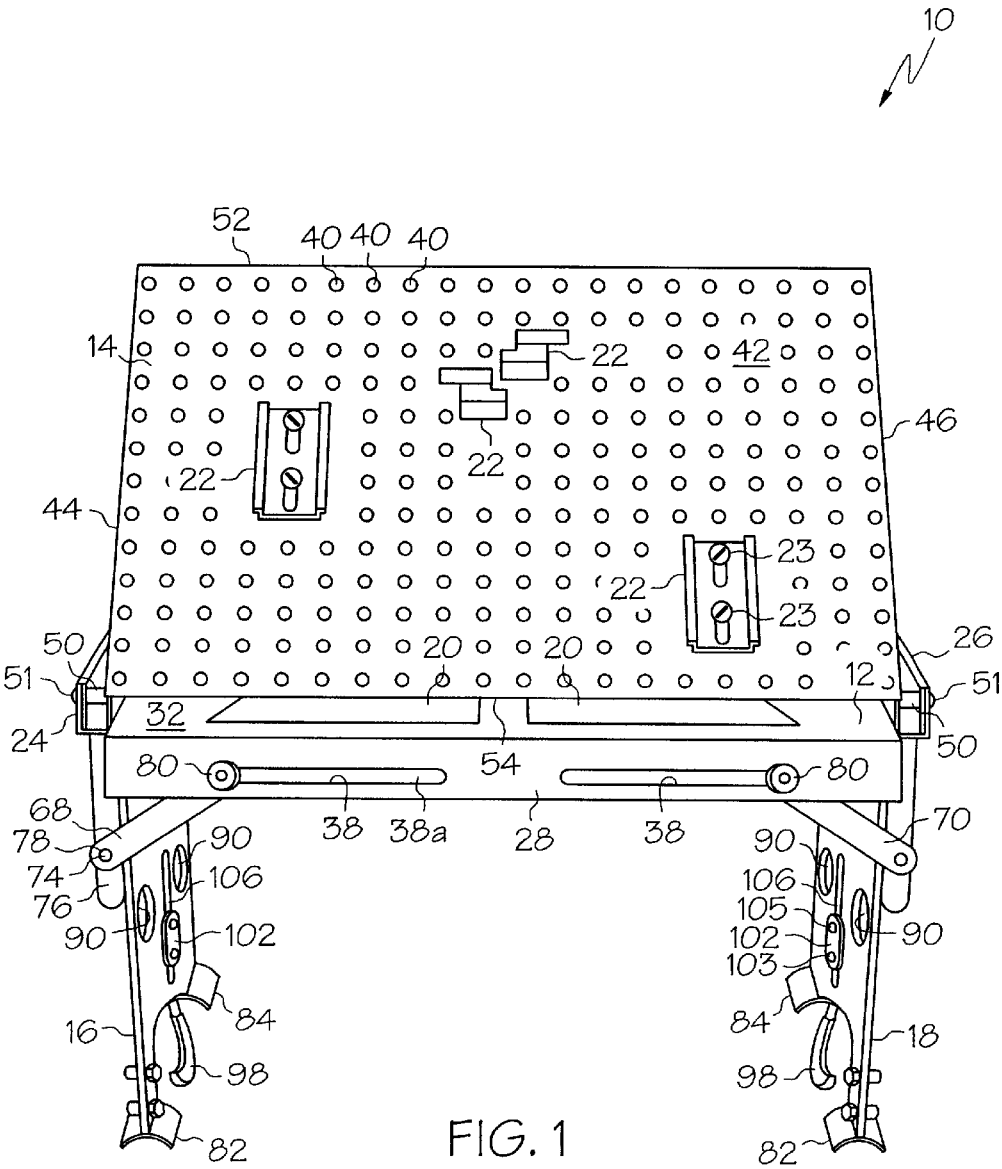
FIG. 1 is a front view of a stretcher table assembly, illustrating the tiltable tabletop with anchoring devices positioned thereon according to an embodiment of the present invention.
Figure 2:
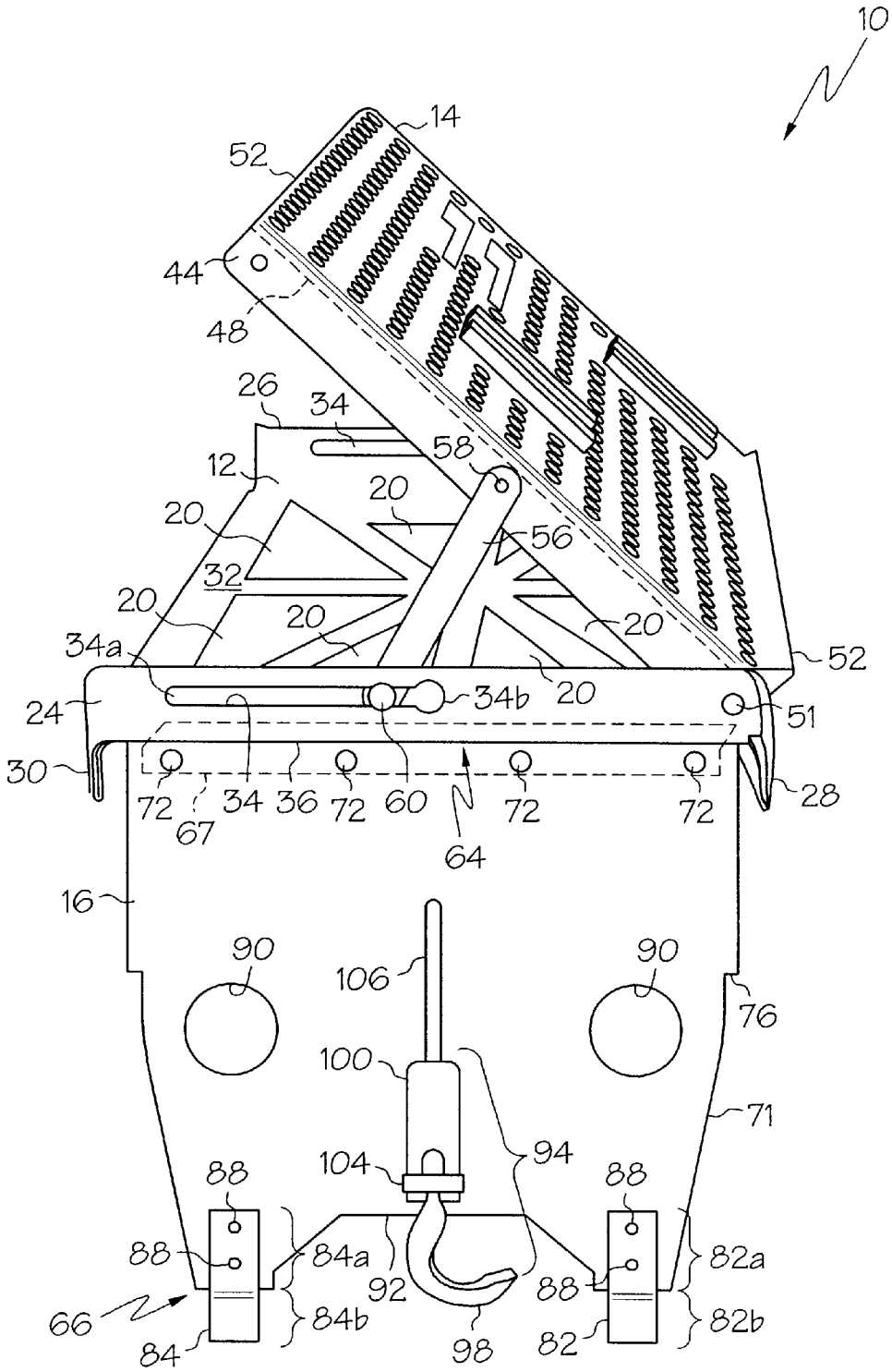

Referring to FIGS. 1 and 2, a stretcher table assembly 10 includes a support frame 12, a support surface or tabletop 14, a first leg 16 and a second leg 18. The support frame 12 includes a substantially planar surface with a plurality of cutouts 20 to reduce the overall weight of the stretcher table assembly 10. The support frame 12 is preferably generally rectangular in shape having a first upwardly sloping or raised end 24 opposing a second raised end 26, and a first downwardly sloping or lowered end 28 opposing a second lowered end 30. Each of the first and second ends 24, 26 rise above a top surface 32 of the support frame 12 and includes an integral slot 34 which extends from about each raised side's midpoint to about adjacent the second lowered end 30. Each of the first and second lowered ends 28, 30 extends below a bottom surface 36 of the support frame 12 and includes a pair of slots 38.

The tabletop 14 is substantially planar and includes a plurality of holes 40 to provide a grid upon which anchoring devices 22, adapted to hold emergency medical equipment 86 (FIG. 3), maybe selectively positioned onto a top surface 42 of the tabletop 14. The anchoring devices 22 which are releasably fastened to the tabletop, such as by nuts and bolts 23, may be repositioned anywhere within the grid of holes 40 to accommodate various types of emergency medical equipment 86. A locking member (not shown), which is provided to each piece of emergency medical equipment 86, engages one of the anchoring devices 22 affixed to the tabletop 14, thereby removably affixing the emergency medical equipment 86 to the tabletop 14 at a particular position thereon quickly and easily without the need of adjusting a strap or buckle as required in prior art stretcher tables. The emergency medical equipment 86 can be repositioned on the tabletop surface simply by relocating the anchoring devices to another location thereon.

The tabletop 14 is preferably generally rectangular in shape having a first downwardly sloping or lowered end 44 opposing a second lowered end 46, and in which both lowered ends 44, 46 extend below a bottom surface of the tabletop, which is indicated by dash line 48 in FIG. 2. The tabletop 14 is mounted between the first and second raised ends 24, 26 of the support frame by a pin 50. The pin 50 is secured at it ends, such as by a nut or stud fastener 51, to the raised ends 24, 26 adjacent the first lowered end 28 of the support surface 12. Accordingly, the tabletop 14 may be titled upwards or inclined by a free end 52 above its pinned end 54.

Figure 3:
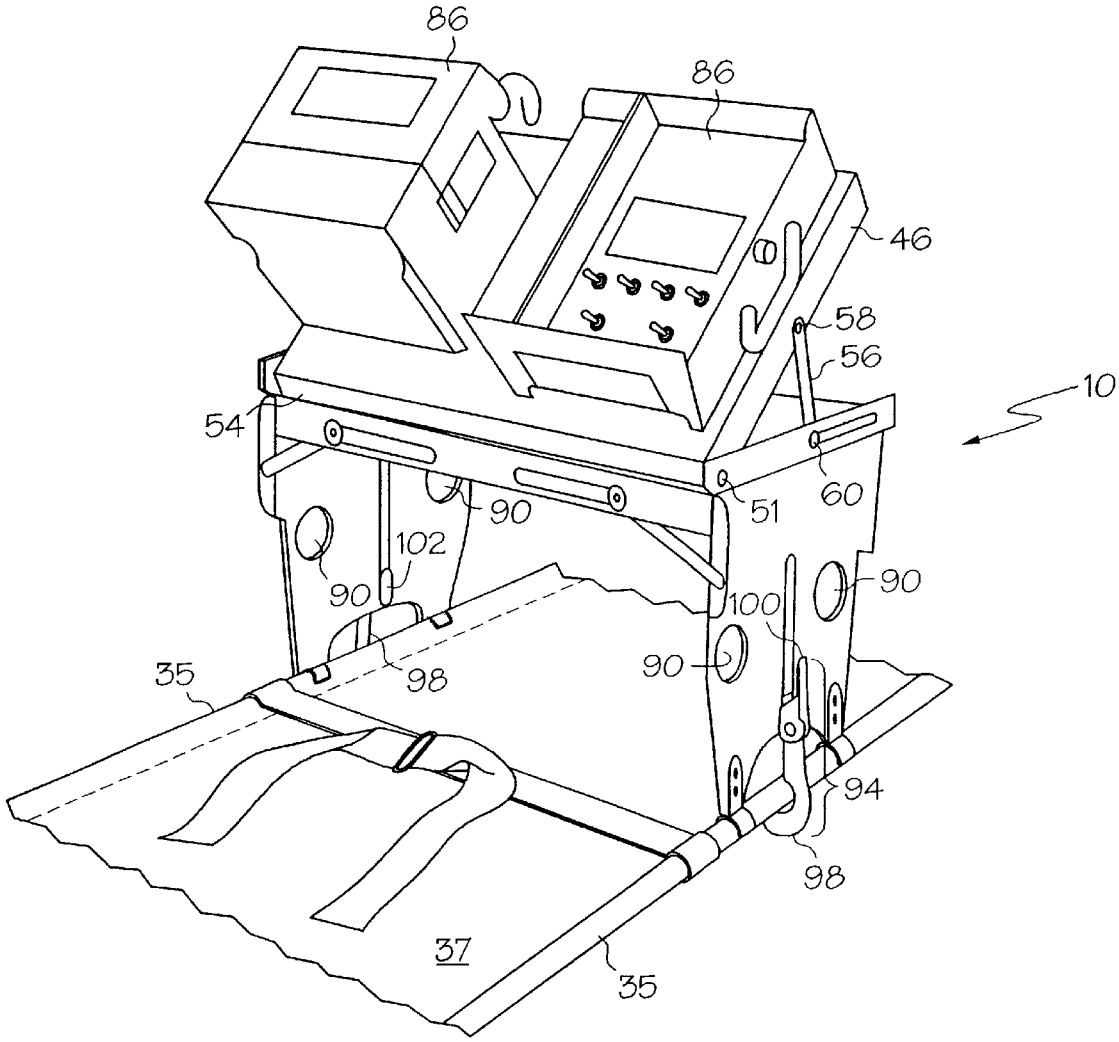
FIG. 3 is a perspective view of the stretcher table assembly illustrated in FIG. 1, illustrating the stretcher table assembly fastened to an emergency stretcher and emergency medical equipment secured thereon according to an embodiment of the present invention.

A pair of opposed arms 56, illustrated in FIGS. 2 and 3, are each rotatably mounted at a first end 58 to one of the first and second lowered ends 44, 46, and slidably mounted at each second end by a fastener 60 within the respective slot 34 of the first and second raised ends 24, 26 of the support frame 12. Each of the slots 34 of the support frame 12 is keyhole shaped with a first oblong portion 34*a* and a second circular portion 34*b* having a diameter greater than a vertical length of the first oblong portion 34*a*, which is best viewed by FIG. 2. Each fastener 60 includes a first portion (not shown) having a diameter slightly less than the diameter of the second circular portion 34*b* but greater than the vertical length of the first oblong portion 34*a* and a second portion (not shown) having a diameter slightly less than the vertical length of the first oblong portion 34*a*. The second end of each one of the pair of arms 56 is thus able to translate back and forth through its respective slot 34 when the second portion of its fastener 60 is positioned anywhere within its respective slot 34. The second end of each one of the pair of arms 56 is locked in place when the first portion of its fastener 60 is positioned within the second circular portion 34*b* of slot 34. The second end of each one of the pair of arms 56 is maintained within second circular portion 34*b* of slot 34 through a spring (not shown) between the first and second portions of fastener 60. Since the diameter of the first portion of the fastener 60 is greater than the vertical length of the first oblong portion 34*a* of slot 34, the second end of each of the pair of arms 56, is locked in place until a sufficient amount of force is applied to one of the pair of arms 56 to counter the force of the spring and dislodge the first portion of the influenced fastener 60 from the second circular portion 34*b* of its respective slot 34. The slidably second ends of the pair of arms 56 when positioned into their associated second circular portion 34*b* of the slots 34 secure the tabletop 14 in an inclined position, which is illustrated in FIG. 3. With the tabletop 14 secured in the inclined position, emergency medical equipment 86 secured thereon by the provided anchoring devices 22 (FIG. 1) can be better viewed by medical personnel when the stretcher table assembly 10 is secured to rails 35 of a typical ambulance stretcher 37 (partially indicated). The typical ambulance stretcher includes a mattress, rails, and a set of collapsible wheels (not shown).

Figure 4:
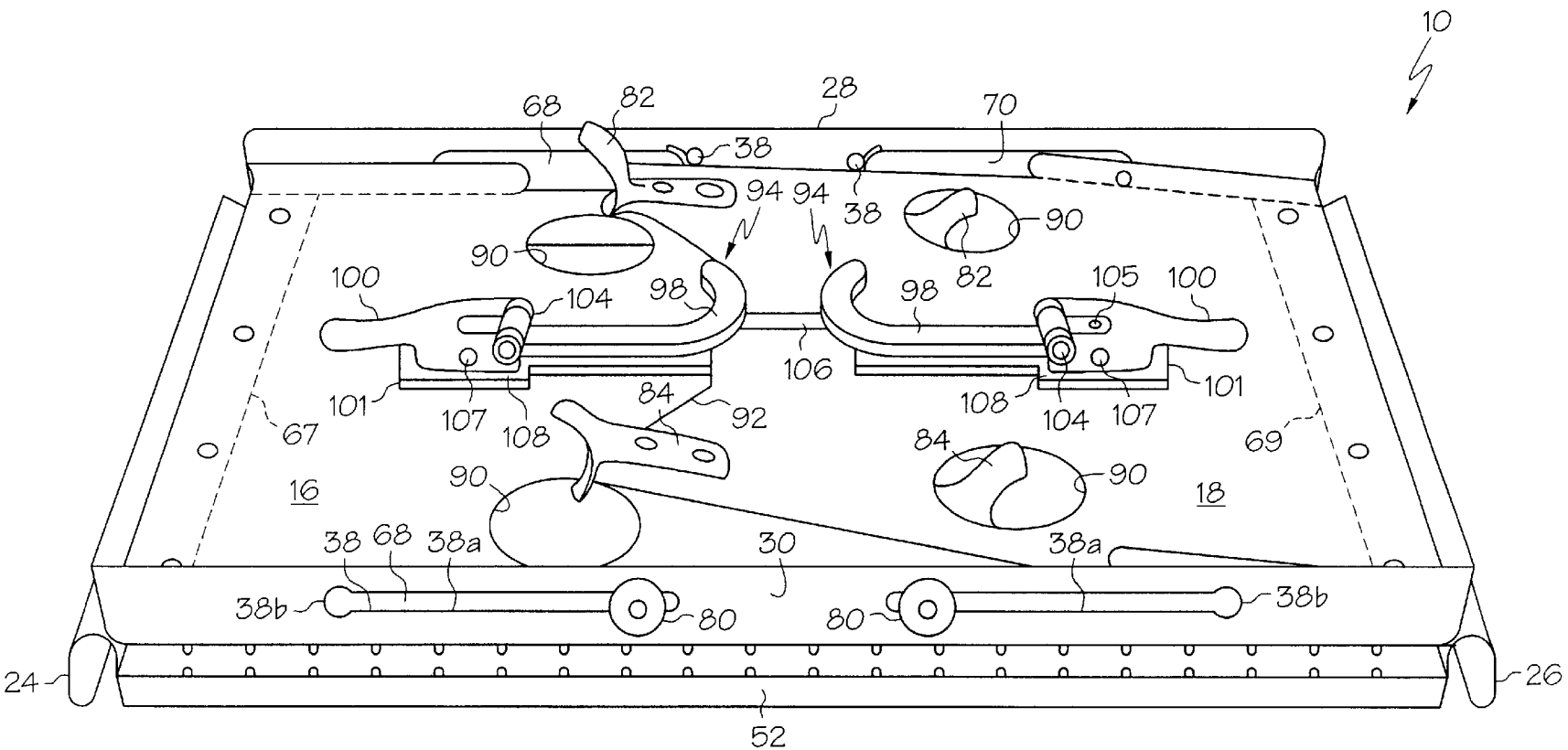
FIG. 4 is a perspective bottom view of the stretcher table assembly illustrated in FIG. 1, illustrating the stretcher table assembly compacted.

The first and second legs 16, 18 each include a first end 64 and a second end 66. The first end 64 of the first leg 16 is coupled to the bottom surface 36 of the support frame 12 generally adjacent the first raised end 24 through a first hinge, indicated by hidden line 67 in FIGS. 2 and 4, and a first pair of bracket arms 68 (FIGS. 1 and 4). Similarly, the first end 64 of the second leg 18 is coupled to the bottom surface 36 of the support frame 18 generally adjacent the second end 26 through a second hinge, indicated by hidden line 69 in FIG.4, and a second pair of bracket arms 70 (FIGS. 1 and 4). It should be appreciated by those skilled in the art that the legs 16, 18 are of a sufficient length to mount the assembly 10 over a patient situated on the stretcher 37. Additionally, since the first and second legs 16, 18 are mounted to the support frame 12 on both of their sides in the same manner, the following description will be limited to the mounting of the first leg 16 only on a first side 71 (FIG. 2).

A first portion of the first hinge 67 is coupled to the bottom surface 36 of support frame 12 generally adjacent the first end 24 using conventional fasteners (not shown). A second portion of the first hinge 67 is coupled to the first leg 16, generally adjacent the first end 64, using conventional fasteners 72. Referring to FIG. 1, to the first side 71 of leg 16 a first end 74 of bracket arm 68 is rotatably coupled to a shoulder portion 76 of leg 16 using conventional fastener 78. A second end of bracket arm 68 is slidably coupled to slot 38 on lowered end 28 of support frame 12 using fastener 80. Since fastener 80 is the same as fastener 60 no further discussion on its construction is provided. As with the slots 34 of the support surface 12, the slot 38 is keyhole shaped with a first oblong portion 38*a* and a second circular portion 38*b* (FIG. 4) having a diameter greater than a vertical length of the first oblong portion 38a. Accordingly, the second end of bracket arm 68 is thus able to translate back and forth through slot 38 when the fastener 80 is positioned anywhere within slot 38. The second end of bracket arm 68 is locked in place when the fastener 80 is positioned within second circular portion 38*b* of slot 38. The second end of bracket arm 68 is maintained within second circular portion 38*b* of slot 38 through a spring (not shown) acting on fastener 80 in a similar fashions as fastener 60, and thus no further discussion is provided.

As illustrated in FIG. 1, with the pair of bracket arms 68, 70 locked, the legs 16, 18 of the stretcher table are secured in an upright position, wherein the legs 16, 18 are substantially perpendicular to the bottom surface 36 of support frame 12. It should be apparent that with the pair of bracket arms 68, 70 unlocked, the legs 16, 18 may pivot about their respective hinges 67, 69. As illustrated in FIG. 4, pivoting the legs 16,18 substantially parallel to the bottom surface 36 of support frame 12 permits the legs to be placed in a compact or folded position for ease of storage. It will be appreciated by those skilled in the art that the legs 16,18 may be rigidly coupled to a support frame of a stretcher without departing from the scope of the present invention. It will be further appreciated by those skilled in the art that other means may be used to couple the legs 16, 18 to the support frame 12 without departing from the scope of the present invention.

The first and second legs 16, 18 each include a first attachment foot 82 and a second attachment foot 84 positioned generally adjacent the second end 66. The attachment feet 82, 84 are preferably spaced near the opposite sides of the second end 66. The attachment feet 82, 84 are generally Y-shaped with a first portion 82*a*, 84*a* extending generally perpendicular from respective legs 16, 18 and a second portion 82*b*, 84*b* extending generally parallel with respect to respective legs 16, 18. The attachment feet 82, 84 are coupled to the first and second legs 16, 18 using conventional fasteners 88. While the attachment feet 82, 84 have been shown as separate and distinct components, it will be appreciated by those skilled in the art that the attachment feet 82, 84 may be formed integrally with the legs 16, 18 without departing from the scope of the invention. It will be further appreciated by those skilled in the art that a single attachment member may be used without departing from the scope of the present invention.

Preferably, each of the first and second legs 16, 18 include a pair of cutouts 90 to receive the attachment feet 82, 84 of the opposite leg when the legs 16, 18 are in the compact position, which is best viewed by FIG. 4. Further, each of the first and second legs 16, 18 preferably include a cutout 92 between the attachment feet 82,84 to reduce the weight of the stretcher table assembly 10 and to serve as handles when positioning the stretcher table assembly 10 onto the stretcher 37 (FIG. 3). Preferably, the support frame 12, the tabletop 14, and legs 16, 18 are composed of sturdy, light weight material, such as aluminum, stainless steel or titanium. As will be appreciated by those skilled in the art, the support frame 12, the tabletop 14, and legs 16, 18 may also be composed of a suitable plastic or plastic reinforced composite material. It will be further appreciated by those skilled in the art that attachment feet 82, 84 may be shaped differently and/or include other features, such as the L-shaped attachment members and the anti-skidding members disclosed by U.S. Pat. No. 5,845,351, which is herein incorporated by reference.

As shown in FIGS. 1 and 2, the legs 16, 18 include a slot 106 for-slidably engaging the securing mechanism 94 thereto. As best seen in FIG. 2, the securing mechanism 94 includes a hook member 98, an adjuster tab 100, a riding plate 101 (FIG. 4), and a securing plate 102 (FIG. 1). The hook member 98 is pivotally coupled to a bar 104 that is coupled through the riding plate 101 and slot 106 to the securing plate 102 by a bolt 103 (FIG. 1). The adjuster tab 100 is rotatably coupled through the riding plate 101 and slot 106 to securing plate 102 by an eye bolt 105 that is engaged with fastener 107 (FIG. 4). It should be appreciated that the bolts 103, 105 are sized to provide a suitable spacing between the riding plate 101 and securing plate 102 to permit the securing mechanism 94 to slide along slot 106 when the adjuster tab 100 is in an unengaged position (not shown). Accordingly, the hook member 98 may be positioned around the respective rail 35 of the stretcher 37 (FIG. 3) and the securing mechanism 94 may be adjusted until the hook member 98 is reasonable tight against the rail 35 when the adjuster tab 100 is in the unengaged position. As shown in FIG. 3, with the hook member 98 properly positioned on the rails 35 the adjuster tab 100 is then placed to a securing position. Moving the adjuster tab 100 to the securing position presses the riding plate 101 and sliding plate 102 towards each other against its respective leg 16 or 18 by sliding a wedge portion 108 (FIG. 4) of its shape between bar 104 and riding plate 101. Placing the wedge portion 108 of the adjuster tab 100 in the engage position takes up the slack spacing between the riding plate 101 and securing plate 102 thereby providing pressure which locks the securing mechanism 94 and hook member 98 in place. It is to be appreciated the in the unengaged position, the wedge portion 108 of the adjuster tab 100 is released from this interference fit between the bar 104 and riding plate 101 thereby permitting the securing mechanism 94 to slide along slot 106.

Once both hook members 98 are secured in place as described above, the stretcher table assembly 10 is securely fastened to the stretcher 37, such that the stretcher table assembly 10 may withstand the forces associated with ordinary movement of the stretcher 37 as well as sudden forces which may be imparted during sudden braking, acceleration, or turning of an ambulance. Further, the stretcher table assembly 10 may be easily attached, adjusted and removed by moving the adjuster tab 100 and manipulating the securing mechanism 94. It should be appreciated by those skilled in the art that the first and second legs 16, 18 may be secured to the rails 35 of the stretcher 37 by that other types of securing mechanisms without departing from the scope of the present invention, such as flexible straps looping around the rails 35 through cut-outs provided in the stretcher bed, hook fasteners coupled to flexible straps, or a D-ring locking mechanism, all of which are disclosed by U.S. Pat. No. 5,845,351 and which are herein incorporated by reference.

Having described the invention in detail and by reference to preferred embodiments thereof, it will be apparent that modifications and variations are possible without departing from the scope of the invention which is defined in the appended claims.

What is claimed is:

1. A stretcher table assembly for a stretcher having rails comprising:

a support frame having first and second ends opposing one another;

a substantially planar support surface pivotally connected to said support frame and adapted to be releasably secured in an inclined position;

a first leg having first and second ends, said first end pivotably coupled to said support frame generally adjacent said first end of said support frame such that said leg may fold underneath said support frame, said first leg further comprising an attachment member positioned generally adjacent said second end of said first leg and a first securing mechanism adapted to be releasably and securely attached to a respective rail of the stretcher; and a second leg having first and second ends, said first end pivotably coupled to said support frame generally adjacent said second end of said support frame such that said second leg may fold underneath said support frame, said second leg further comprising an attachment member positioned generally adjacent said second end of said second leg and a second securing mechanism adapted to be releasably and securely attached to a respective rail of the stretcher.

2. The assembly of claim 1, wherein said first and second securing mechanisms each comprise a hook member adapted to be releasably and securely attached to a respective rail of a stretcher by engaging said respective rail with said hook member.

3. The assembly of claim 1, wherein each of said attachment members of each of said first and second legs comprises a first attachment foot and a second attachment foot.

4. The assembly of claim 1, wherein said support surface-includes a plurality of holes arranged. in a grid.

5. The assembly of claim 4, further including at least one locking device on said support surface.

6. The assembly of claim 1, wherein said support frame includes cutouts to reduce the weight of said assembly.

7. The assembly of claim 1, wherein said first and second legs include cutouts to reduce the weight of said assembly and at least some of said cutouts are adapted for use as lifting handles.

8. The assembly of claim 1, wherein said support surface, said support frame, and said first and second legs comprise a material selected from the group consisting of metal, plastic, and composites.

9. The assembly of claim 1, wherein each of said first and second legs comprises a slot for sidably engaging said first and second securing mechanisms, respectively.

10. A stretcher table assembly comprising:

a substantially planar support frame having first and second ends opposing one another;

a substantially planar support surface pivotally connected to said support frame and adapted to be releasably secured in an inclined position;

a first leg having first and second ends, said first end coupled to said support frame generally adjacent said first end of said support frame, said first leg further including a slot, an attachment member positioned generally adjacent said second end of said first leg, and a securing mechanism slidably engaged in said slot, said securing mechanism adapted to be releasably and securely attached to a respective rail of a stretcher; and a second leg having first and second ends, said first end coupled to said support frame generally adjacent said second end of said support frame, said second leg further including a slot, an attachment member positioned generally adjacent said second end of said second leg, and a securing mechanism slidably engaged in said slot, said securing mechanism adapted to be releasably and securely attached to a respective rail of a stretcher.

11. The assembly of claim 10, wherein each of said attachment members of each of said first and second legs comprises a first attachment foot and a second attachment foot.

12. The assembly of claim 10, wherein said support surface includes a plurality of holes arranged in a grid.

13. The assembly of claim 12, further includes at least one locking device releasably mounted to said support surface.

14. The assembly of claim 10, wherein said support frame includes cutouts to reduce the weight of said assembly.

15. The assembly of claim 10, wherein said first and second legs include cutouts to reduce the weight of said assembly and at least some of said cutouts are adapted for use as lifting handles.

16. The assembly of claim 10, wherein said support surface, said support frame, and said first and second legs comprise a material selected from the group consisting of metal, plastic, and composites.

17. The assembly of claim 10, wherein said securing mechanisms of said first and second legs each include a hook member and adjuster tab, and said assembly is adapted to be secured to a stretcher by sliding said securing mechanisms in said slots of said first and second legs until said hook members are engaged around respective rails on said stretcher, and securing said hook members by rotating said adjuster tabs to a securing position.

18. The assembly of claim 17, wherein each of said securing mechanisms of said first and second legs further includes a sliding plate, a riding plate, and a bar mounted through said riding plate and said slot to said sliding plate, said hook member is coupled to said bar, and said adjuster tab is pivotally coupled through said riding plate and said slot to said sliding plate such that with said adjuster tabs in an unengaged position said securing mechanisms may be adjusted within said respective slots, and with said adjuster tabs in said securing position said sliding plate and said riding plate are pressed towards each other inhibiting movement of said securing mechanisms.

19. The assembly of claim 18, wherein said adjuster tab of each securing mechanism has a wedge portion for engaging between said bar and said riding plate in said securing position.

20. A stretcher table assembly comprising:

a substantially planar support frame having first and second ends opposing one another;

a substantially planar support surface pivotally connected to said support frame and adapted to be releasably secured in an inclined position;

a first leg having first and second ends, said first end coupled to said support frame generally adjacent said first end of said support frame, said first leg further including a slot, an attachment member positioned generally adjacent said second end of said first leg, and a securing mechanism slidably engaged in said slot, said securing mechanism having a hook member and an adjuster tab, and adapted to be releasably and securely attached to a respective rail of a stretcher; and a second leg having first and second ends, said first end coupled to said support frame generally adjacent said second end of said support frame, said second leg further including a slot, an attachment member positioned generally adjacent said second end of said second leg, and a securing mechanism slidably engaged in said slot, said securing mechanism having a hook member and an adjuster tab, and adapted to be releasably and securely attached to a respective rail of a stretcher, wherein said securing mechanisms of said first and second legs are adapted to be secured to said stretcher by sliding said securing mechanisms in said slots of said first and second legs until said hook members are engaged around said respective rails on said stretcher, and securing said hook members by rotating said adjuster tabs to a securing position.

21. A stretcher table assembly for a stretcher having rails comprising:

a support frame;

a substantially planar support surface pivotally attached to said support frame and adapted to be releasably secured in an inclined position;

a pair of legs adapted to fold relative to said support frame into a compact position underneath said support frame, said legs each having first and second ends, said first ends are coupled to said support frame, and said second ends each provide an attachment member positioned adapted to releasably secure said legs to the rails of the stretcher.

* * * * *

UNITED STATES PATENT AND TRADEMARK OFFICE

CERTIFICATE OF CORRECTION

PATENT NO. : 6,446,285 B1
DATED : September 10, 2002
INVENTOR(S) : Robert C. Chinn It is certified that error appears in the above-identified patent and that said Letters Patent is hereby corrected as shown below:

Title page,
Item [73], Assignee, reads as "FernO-Washington, Inc." should read -- Ferno-Washington, Inc. --.

Column 8,
Line 17, reads as "holes arranged. in" should read -- holes arranged in --.
Line 31, reads as "for sidably" should read -- for slidably --.

Signed and Sealed this

Eighteenth Day of February, 2003

JAMES E. ROGAN
*Director of the United States Patent and Trademark Office*